United States Patent [19]

Kamarian

[11] 4,064,031

[45] Dec. 20, 1977

[54] ELECTROLYZER

[76] Inventor: Georgy Mikirtychevich Kamarian, Kotelnicheskaya naberezhnaya, 25/8, kv. 45, Moscow, U.S.S.R.

[21] Appl. No.: 676,875

[22] Filed: Apr. 14, 1976

[30] Foreign Application Priority Data

Apr. 14, 1975 U.S.S.R. ..... 2124810

[51] Int. Cl.[2] ..... C25B 1/16; C25B 1/26; C25B 9/02

[52] U.S. Cl. ..... 204/256; 204/254; 204/258; 204/268; 204/280; 204/286; 204/288

[58] Field of Search ..... 204/254, 258, 256, 268, 204/280, 286, 288

[56] References Cited

U.S. PATENT DOCUMENTS

| | | | |
|---|---|---|---|
| 3,759,815 | 9/1973 | Larsson | 204/268 |
| 3,884,791 | 5/1975 | Raetzsch et al. | 204/268 |
| 3,900,384 | 8/1975 | Gunby | 204/286 |

*Primary Examiner*—Arthur C. Prescott
*Attorney, Agent, or Firm*—Lackenbach, Lilling & Siegel

[57] ABSTRACT

The proposed electrolyzer comprises at least two electrodes having current-distribution supports, whereupon there are mounted electrode members. In said electrolyzer, at least one of the electrodes comprises at least two units having current-distribution supports, whereupon there are mounted electrode members which are joined together along the side edges of their current-distribution supports, the interconnected current-distribution supports of the units making up the current-distribution support of the electrode.

2 Claims, 17 Drawing Figures

ELECTROLYZER

The present invention relates to electrochemical apparatus and, more specifically, to electrolyzers.

The invention is applicable to the electrolysis of solutions of chlorides of alkali metals to produce chlorine, hydrogen and alkali, or to produce chlorates.

At present, both unipolar and bipolar electrolyzers are used for the electrolysis of solutions of chlorides of alkali metals.

Attempts are currently being made to develop electrolyzers of a high unit capacity.

The use of electrolyzers of a high unit capacity helps to reduce the overall number of electrolyzers in a workship, which, in turn, makes it possible to reduce the length of pipelines for the supply of solution, the removal of chlorine, etc., facilitates the maintenance of the electrolyzers and raises the output per unit of floorspace.

There is known an electrolyzer comprising electrodes. One of these electrodes is an anode having a current-distribution support, whereupon there are mounted electrode (anode) members, while the other electrode is a cathode having a current-distribution support whereupon there are mounted electrode (cathode) members.

The current-distribution support of the anode performs the function of the electrolyzer's bottom; the current-distribution support of the cathode performs the function of the walls of the electrolyzer shell. A diaphragm is applied onto the cathode members.

When this type of electrolyzer is used for the production of chlorates, the diaphragm is dispensed with.

There is also known an electrolyzer comprising a shell, wherein there are arranged unipolar electrodes, i.e. an anode and a cathode.

The current-distribution support of both electrodes, i.e. the anode and cathode, is a vertically arranged plate.

The electrode members of the anode are secured to the plate at a certain distance from one another, so that when viewed from the top, the electrode looks shaped as a comb.

The electrode members of the cathode are mounted on another plate at some distance from one another, so that when viewed from the top, the cathode is also comb-shaped.

The electrodes are arranged so that the electrode members of the anode are found in the spacing between the electrode members of the cathode, whereas the electrode members of the cathode are found in the spacing between the electrode members of the anode.

There is further known an electrolyzer comprising two unipolar electrodes, i.e. an anode and a cathode, each having a current-distribution support, whereupon there are mounted electrode members. Arranged between the anode and cathode are bipolar electrodes, each comprising a current-distribution support and electrode (anode and cathode) members mounted on the opposite sides of the current-distribution support.

The electrode members of the cathode are hollow fingers of steel mesh, which are secured to the current-distribution support.

The electrode members of the anode are also hollow fingers. These are made of titanium mesh, whereupon there is applied active anode material.

There is still further known an electrolyzer comprising a shell, wherein there are arranged two unipolar electrodes, i.e. an anode and a cathode, each having a current-distribution support, whereupon there are mounted electrode members. Between the anode and cathode there are arranged bipolar electrodes, each having a current-distribution support and electrode members mounted on both sides of the current-distribution support.

The electrode members of the anode are perforated titanium sheets, whereupon there is applied active anode material. The electrode members of the cathode are hollow fingers attached to a grid which, in turn, is attached to the current-distribution support.

In the foregoing types of electrolyzers, the current-distribution support is a single, solid plate, wherefore it is hard to produce an electrolyzer of a high unit capacity.

This is due to the fact that while keeping the current density constant, an increase in the current load on an electrode makes it necessary to increase the linear dimensions of the electrode, i.e. to increase its height or length.

An increased electrode height leads to a greater amount of gas in the interelectrode space. The result is an increased resistance of the electrolyte and greater non-uniformity of current distribution, which, in the final analysis, leads to increased power consumption.

An increase in the electrode length, and, consequently, an increase in the number of anode and cathode members, makes the electrodes much heavier, which makes it difficult to assemble an electrolyzer and calls for high-power lifting and transportation equipment.

The foregoing factors also make it very difficult to attain a required accuracy in arranging the electrodes.

Thus, an increase in the capacity of an electrolyzer through an increase in the linear dimensions of the existing types of electrodes is possible only to a limited extent.

It is an object of the present invention to increase the unit capacity of electrolyzers.

It is another object of the invention to simplify the operations of assembling and dismantling an electrolyzer of a great unit capacity.

It is still another object of the invention to simplify the manufacture of electrodes to be employed in high-capacity electrolyzers.

It is yet another object of the invention to provide more economical electrodes to be used in high-capacity electrolyzers.

Finally, it is an object of the invention to improve the formation of a diaphragm on the cathode surface of electrolyzers of the diaphragm type, which are used to produce chlorine and alkali, and improve the quality of the cathode diaphragm.

The foregoing and other objects of the present invention are attained by providing an electrolyzer comprising at least two electrodes having current-distribution supports, whereupon there are mounted electrode members, in which electrolyzer at least one of the electrodes comprises, according to the invention, at least two units having current-distribution supports, whereupon there are mounted electrode members, which units are joined together along the side edges of their current-distribution supports, the interconnected current-distribution supports of said units making up a current-distribution support of the electrode.

The invention makes it possible to produce electrodes of a high unit capacity. This is due to the fact that in the proposed type of electrolyzer, the electrodes are composed of individual units, which makes it possible to have an electrode of practically any length.

In addition, the invention simplifies the installation of electrodes in an electrolyzer to a desired accuracy, i.e. simplifies the assembly of an electrolyzer. This is due to the fact that the assembly of an electrolyzer consists in successively installing individual units which make up an electrode, and in that the size of each of said units is much less than that of the electrode. Thus, each unit and, consequently, the whole electrode, can be accurately put in place. As a result, the distance between the electode members is strictly as required, which minimizes power consumption.

The invention also makes less stringent the requirements imposed upon the dimensional accuracy of individual units, which simplifies the manufacture of electrodes and makes them relatively inexpensive.

Besides, the invention makes the repair of an electrolyzer simpler and inexpensive. This is accounted for by the fact that if a portion of the electrode surface has a flaw, only the unit with the surface flaw is replaced, instead of replacing the whole electrode.

If a diaphragm is applied onto the cathode surface of an electrode, the invention makes it possible to improve the quality of the diaphragm. This is due to the face that the diaphragm is applied individually onto each separate unit, i.e. onto a smaller cathode surface, whereby the conditions for the formation of a diaphragm are improved.

These and other objects and advantages of the present invention will become more apparent from the following detailed description of preferred embodiments thereof taken in conjunction with the accompanying drawings, wherein.

Figure 13:
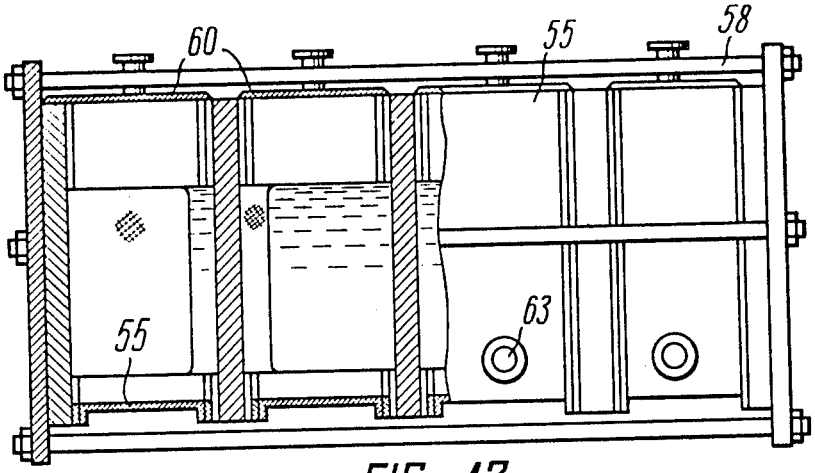
Figure 12:
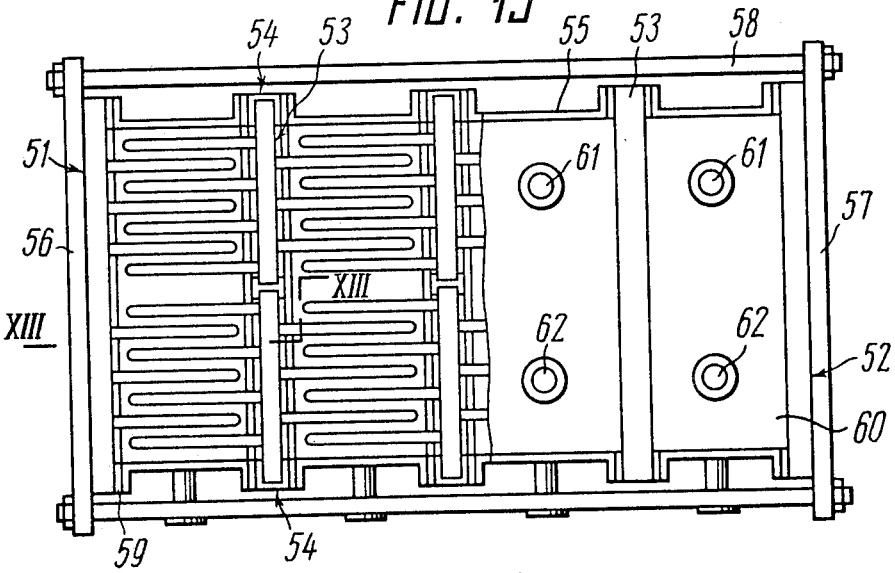
FIG. 12 is a plan view of another embodiment of an electrolyzer in accordance with the invention.
Figure 14:
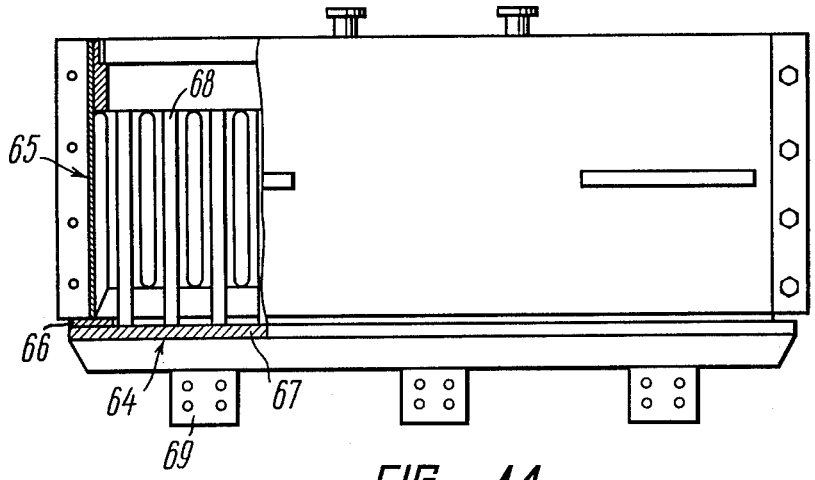
Figure 15:
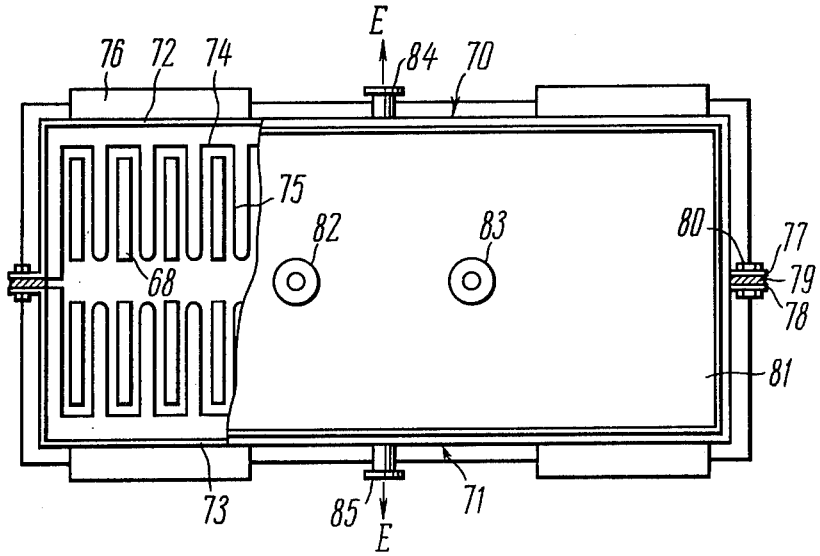
Figure 16:
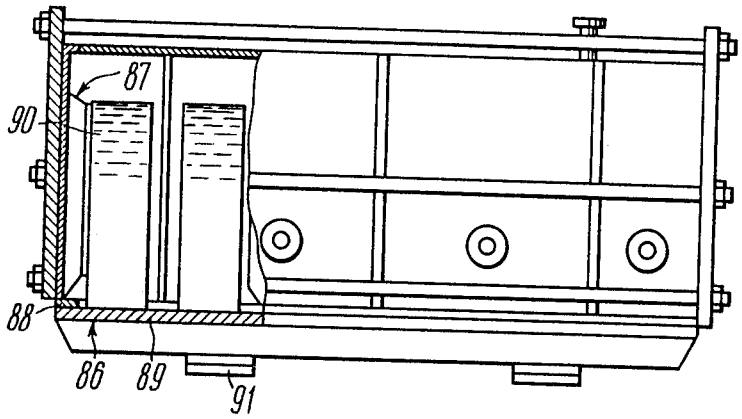
Figure 17:
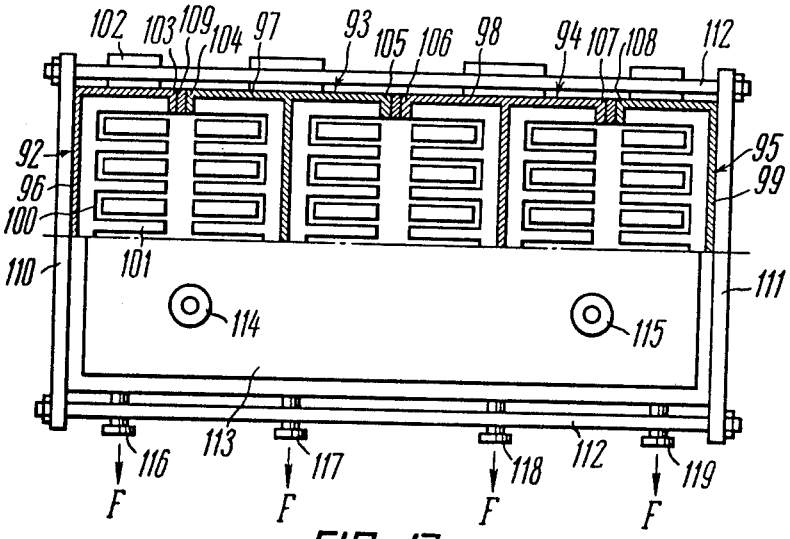

FIG. 13. is a sectional view taken along the line XIII-XIII of FIG. 12;

FIG. 14 is a side elevational view, with part of the wall broken away to show interior details, of a unipolar electrolyzer in accordance with the invention;

FIG. 15 is a plan view, with part of the cover broken away to show interior details, of the unipolar electrolyzer of FIG. 14;

FIG. 16 is a side elevational view, with part of the wall broken away to show interior details, of another embodiment of a unipolar electrolyzer in accordance with the invention; an FIG. 17 is a plan view, with part of the cover broken away to show interior details, of the unipolar electrolyzer of FIG. 16.

Given below is a description of bipolar and unipolar electrolyzers in accordance with the invention.

The bipolar electrolyzer of the present invention comprises a shell 1 (FIG. 1) with a metal cowling 2. The shell 1 houses unipolar electrodes, an anode 3 and a cathode 4, between which there are arranged bipolar electrodes 5. On top, the electrolyzer is covered with a cover 6.

Figure 1:
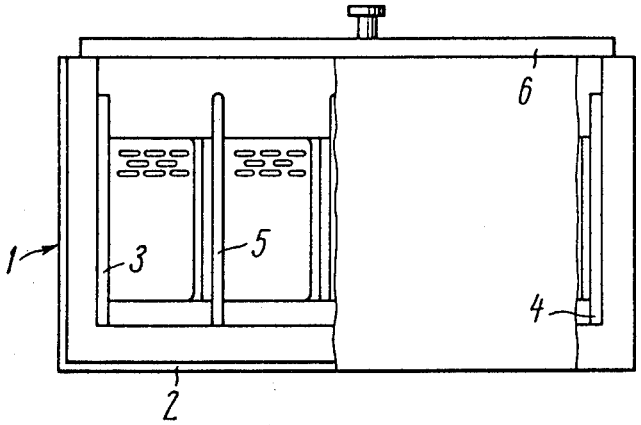
FIG. 1 is a side elevational view, partially wall broken away at the side wall to show interior details, of a bipolar electrolyzer in accordance with the invention.
Figure 2:
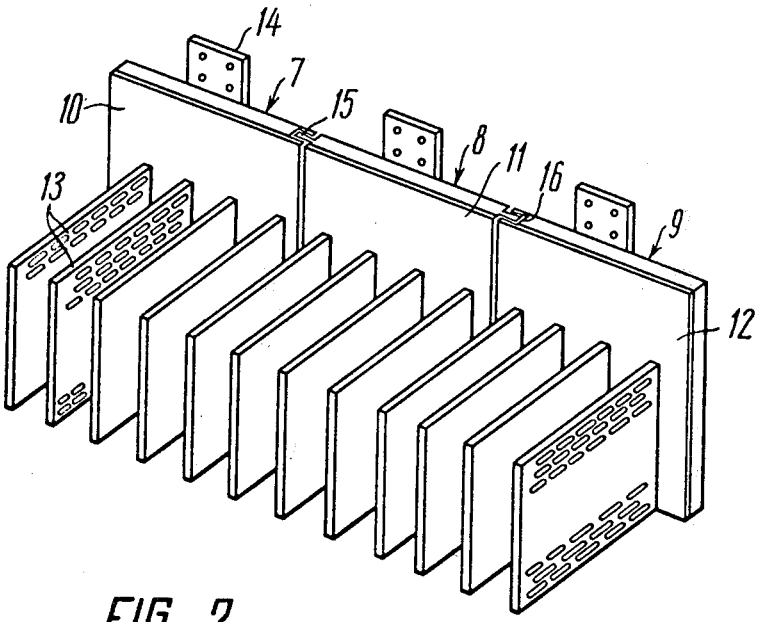
FIG. 2 is an a perspective view of an anode of a bipolar electrolyzer in accordance with the invention, which anode is composed of units.

The anode 3 of the bipolar electrolyzer comprises three units 7, 8 and 9 (FIG. 2). Each of the units 7, 8 and 9 has a current-distribution support, 10, 11 and 12, respectively. Each of the current-distribution supports 10, 11 and 12 is made of an electrically conducting sheet material, for example, steel-titanium bimetal. To each of the current-distribution supports 10, 11 and 12 there are attached four anode members 13 spaced at an equal distance from one another. The anode members 13 are perforated titanium plates, whereupon there is applied active anode material, for example, ruthenium dioxide. As far as the first and fourth anode members 13 of each of the units 7, 8 and 9 are concerned, the active material is only applied onto the inner side of these anode members. Connected to the current-distribution supports 10, 11 and 12 are current-conducting buses 14. The units 7, 8 and 9 are joined together with the aid of a projection 15 and a recess 16 provided on the side edges of the current-distribution supports 10, 11 and 12. The interconnected current-distribution supports 10, 11 and 12 of the units 7, 8 and 9 make up the current-distribution support of the anode 3 (FIG.1).

Figure 3:
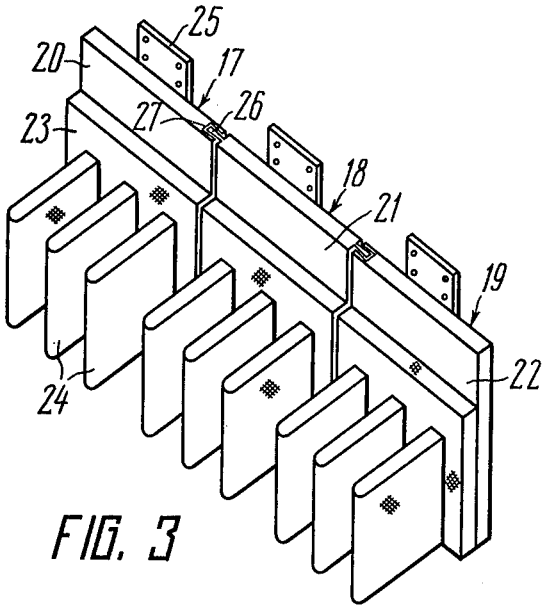
FIG. 3 is an a perspective view of a cathode of a bipolar electrolyzer in accordance with the invention, which cathode is composed of units.

The cathode 4 of the bipolar electrolyzer comprises three units 17, 18 and 19 (FIG. 3). Each of the units 17, 18 and 19 has a current-distribution support, 20, 21 and 22, respectively, which are made of sheet steel. To each of the current-distribution supports 20, 21 and 22 there is attached a cathode grid 23 with three cathode members 24 spaced at an equal distance from one another.

The cathode grid 23 and cathode members 24 are made of steel mesh. The cathode members are hollow fingers. Connected to the current-distribution supports 20, 21 and 22 are current-conducting buses 25. The units 17, 18 and 19 are joined together in a manner similar to the joining of the units 7, 8 and 9 (FIG. 2), with the aid of a projection 26 (FIG. 3) and a recess 27 provided on the side edges of the current-distribution supports 20, 21 and 22. The interconnected current-distribution supports 20, 21 and 22 of the units 17, 18 and 19 make up the current-distribution support of the cathode 4 (FIG. 1).

Figure 4:
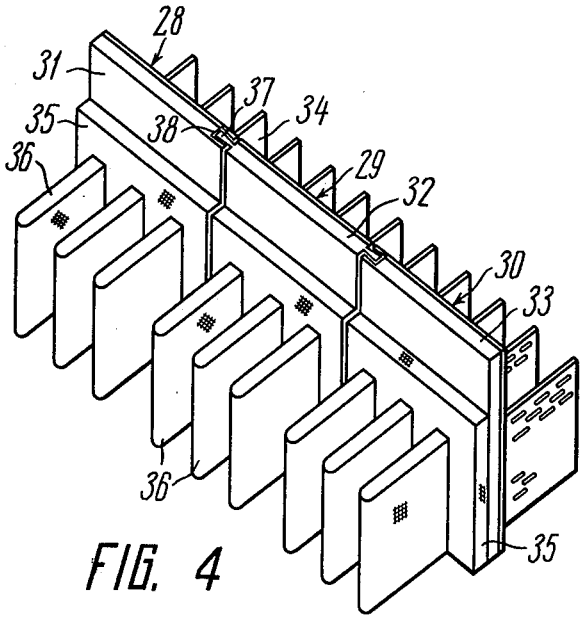
FIG. 4 is an a perspective view of a bipolar electrode of a bipolar electrolyzer in accordance with the invention, which bipolar electrode is composed of units.

The bipolar electrode 5 of the bipolar electrolyzer comprises three units 28, 29 and 30 (FIG. 4). Each of the units 28, 29 and 30 has a current-distribution support, 31, 32 and 33, respectively, which are made of bimetal, for example, steel-titanium. To each of the current-distribution supports, on the side of the titanium layer, there are attached four anode members 34 spaced at an equal distance from one another. Mounted on the opposite side is a cathode grid 35 with three cathode members 36 spaced at an equal distance from one another. The anode members 34 are similar to the anode members 13 (FIG. 2) of the anode 3 (FIG. 1). The cathode members 36 (FIG. 4) are similar to the cathode members 24 (FIG. 3) of the cathode 4 (FIG. 1). The units 28, 29 and 30 (FIG. 4) are joined together like the units 7, 8 and 9 (FIG. 2), with the aid of a projection 37 and a recess 38 provided on the side edges of the current-distribution supports 31, 32 and 33. The interconnected current-distribution supports 31, 32 and 33 of the units 28, 29 and 30 make up the current-distribution support of the bipolar electrode 5 (FIG. 1).

Figure 5:
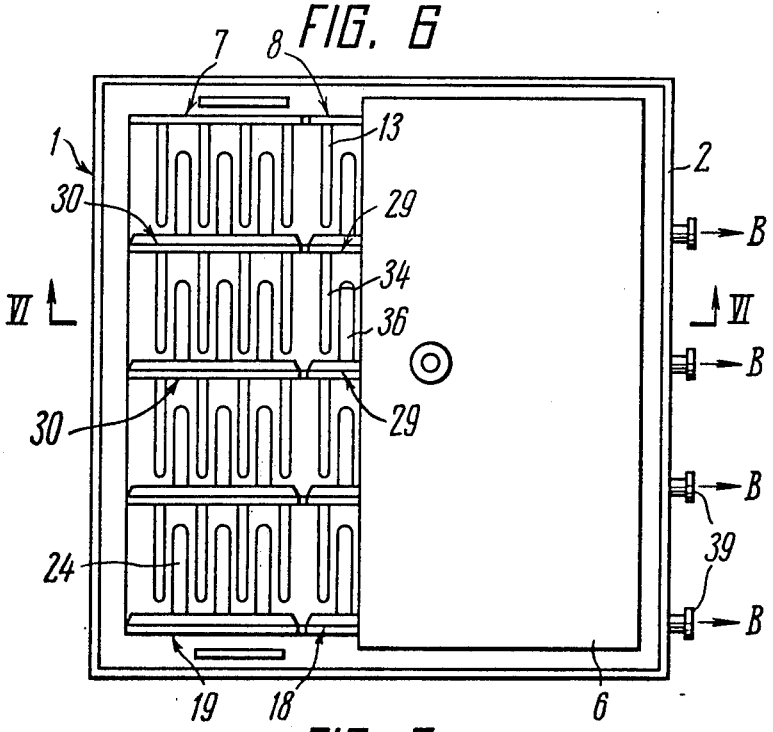
FIG. 5 is a plan view, with part of the cover broken away to show interior details, of a bipolar electrolyzer in accordance with the invention.

The bipolar electrolyzer is provided with outlet pipes 39 (FIG. 5) for the removal of cathode products in the direction of the arrow B.

The cathode members 24 or 36 (FIGS. 2, 3 and 4) are arranged between the anode members 13 or 34. The number of the cathode members 24 in the units 17, 18 and 19 and the cathode members 36 in the units 28, 29 and 30 is less by one than the number of the anode members 13 in the units 7, 8 and 9 and the anode members 34 in the units 28, 29 and 30, so there are no cathode members between the extreme anode members 13 (FIG. 5) of the adjacent units 7 and 8 or 8 and 9 and between the extreme anode members 34 of the adjacent units 28 and 29 or 29 and 30.

Figure 6:
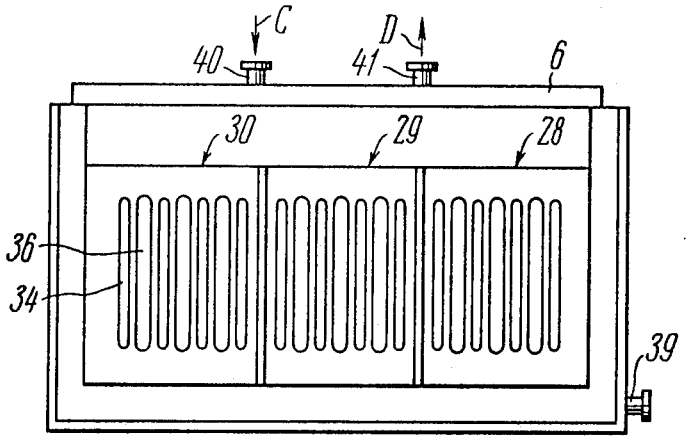
FIG. 6 is sectional view taken along a the line VI-VI of FIG. 5.

Installed in the cover 6 (FIG. 6) of the bipolar electrolzyer are an inlet pipe 40 for the supply of electrolyze in the direction of the arrow C and an outlet pipe or first means 41 for the removal of anodic products in the direction of the arrow D.

Figure 7:
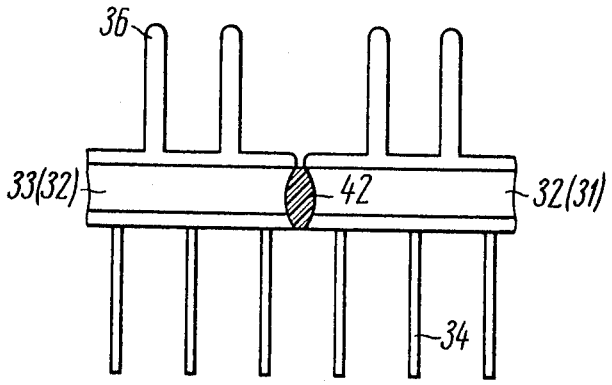
FIGS. 7, 8 and 9 are plan views of units in accordance with the invention, joined together in different ways.
Figure 8:
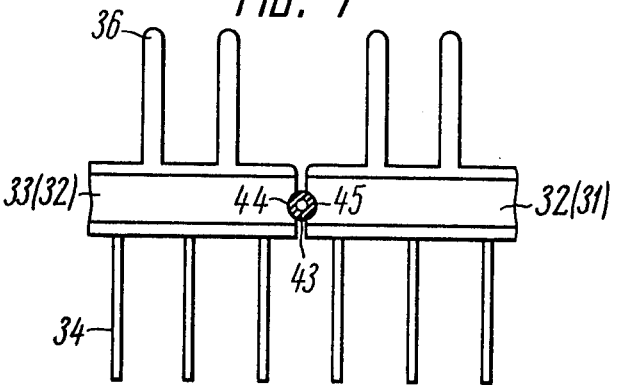
Figure 9:
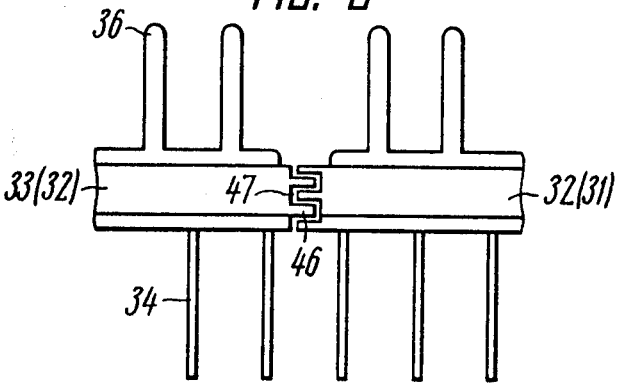

FIGS. 7, 8 and 9 show alternative ways of joining together the electrode units.

According to FIG. 7, the units are joined together by means of a filler 42 placed between the side planes of the current-distribution supports 33 and 32 or 32 and 31. The side planes of the current-distribution supports 33 and 32 or 32 and 31, between which there is placed the filler 42, are concave. The filler is a chemically and thermally resistant material whose fusing temperature is higher than the temperature at which the electrolysis is carried out. This material may be, for example, oil tar whose softening temperature is 130° C. Fused material of this type is poured between the side planes of the current-distribution supports 33 and 32 (32 ad 31). When hardened, this material serves as the filler 42.

According to FIG. 8, the units are joined together by means of a pneumatic tube 43 inserted in annular slots 44 and 45 provided on the side planes of the adjacent current-distribution supports 33 and 32 or 32 and 31. The tube 43 is of an elastic material having a good stability under the conditions at which the electrolysis is carried out. This material may be, for example, rubber.

According to FIG. 9, the units are joined together by means of rectangular protrusions 46 and recesses 47 provided on the side planes of the adjacent current-distribution supports 33 and 32 (or 32 and 31). The protrusions 46 and recesses 47 have a protective coating which may be, for example, a film of polyvinylchloride (not shown).

Figure 10:
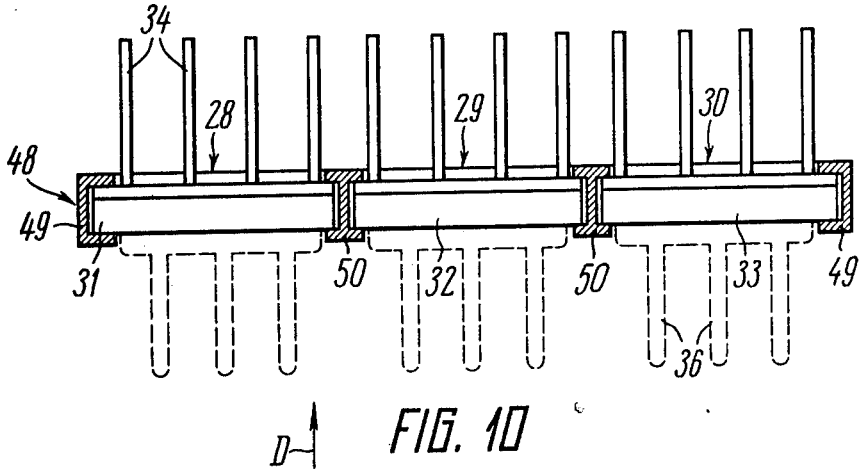
FIG. 10 is a plan view of units in accordance with the invention, joined together in a cassette-type union.

According to FIG. 10, the units are joined together by means of a rectangular cassette 48 which has side walls 49 and two partitions 50. In the cross-section, the partitions 50 are shaped as I-beams and divide the inside of the cassette 48 into three compartments. The units 28, 29 and 30 are installed in said compartments. The side walls of their current-distribution supports 31, 32 and 33 are received in slots provided in the walls 49 and partitions 50. The cassette 48 is manufactured from a chemically resistant material, for example, titanium.

Figure 11:
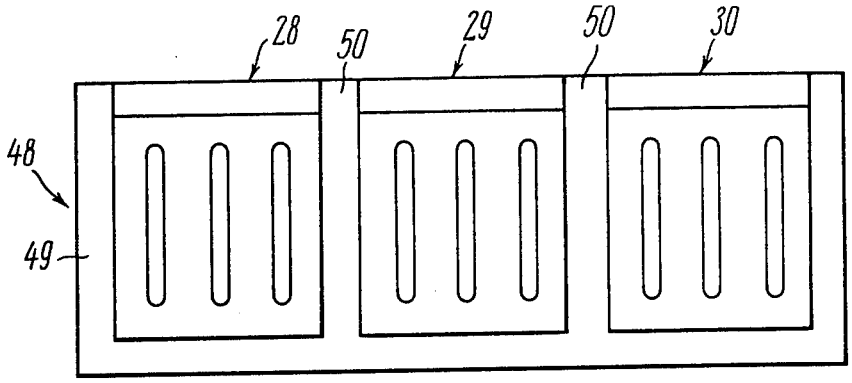
FIG. 11 is a view taken along the arrow D of FIG. 10.

FIG. 11 is a side elevational view of FIG. 10, taken in the direction of the arrow D.

An alternative embodiment of a bipolar electrolyzer in accordance with the invention, shown in FIG. 12, is an electrolyzer of the filter-press type.

This electrolyzer comprises unipolar electrodes which are a cathode 51 and an anode 52 between which there are arranged bipolar electrodes 53. According to the invention, the bipolar electrodes 53 are composed of individual units joined together by means of a cassette 54. The cassette 54 is similar to the cassette 48 (FIG. 10), but it has two compartments, wherein there are installed the units of the bipolar electrode 53. The shell of the electrolyzer is composed of separate sheet metal drums 55, for example, of titanium.

The cathode 51, bipolar electrodes 53, anode 52, and drums 55 are joined into a single assembly by means of supporting plates 56 and 57 and anchor bolts 58. Between the drums 55 and cathode 51, and the bipolar electrodes 53 and anode 52, there are placed electrically insulating sealing gaskets 59. On top, the electrolyzer is covered with covers 60 whose number is determined by the number of the bipolar electrodes 53. Each of the covers 60 has an inlet pipe 61 for the supply of electrolyte and an outlet pipe or first means 62 for the removal of anodic products.

The side wall of each of the drums 55 has an outlet pipe 63 or second means (FIG. 13) for the removal of cathodic products.

FIG. 14 shows a unipolar electrolyzer comprising an anode 64 and a cathode 65. Placed between the anode 64 and cathode 65 is an electrically insulating sealing gasket 66. The anode 64 has a current-distribution support 67 whereupon there are mounted anode members 68. The current-distribution support 67 of the anode 64 is the bottom of the electrolyzer. Connected to said current-distribution support 67 are current-conducting buses 69. The current-distribution support 67 is made of sheet metal, for example, steel, and has a protective coating which may be, for example, a thin sheet of titanium (not shown). The anode members 68 are made of perforated titanium sheets, onto which there is applied active anode material, for example, ruthenium dioxide (not shown).

The cathode 65 comprises two units 70 and 71 (FIG. 15). The units 70 and 71 have their respective current-distribution supports 72 and 73 made of sheet steel. Attached to each of the current-distribution supports 72 and 73 is a cathode grid 74 with cathode members 75. The cathode grid 74 and cathode members 75 are made of steel mesh. The cathode members 75 are hollow fingers which are spaced equidistantly with respect to one another. Connected to the current-distribution supports 72 and 73 are current-conducting buses 76. To the side walls of the current-distribution supports 72 and 73 there are welded flanges 77 and 78 provided with threaded holes for bolts. Between the flanges 77 and 78 there is placed a sealing gasket 79. The units 70 and 71 are joined together by bolts 80. The current-distribution supports 72 and 73 are joined together by a tight joint and make up the walls of the electrolyzer shell. The electrolyzer is covered with a cover 81 provided with an inlet pipe 82 for the supply of electrolyte and an outlet pipe or first means 83 for the removal of anodic products. The current-distribution supports have outlet pipes or second means 84 and 85 for the removal of cathodic products in the direction of the arrow E.

Another alternative embodiment of a unipolar electrolyzer in accordance with the invention (FIG. 16) comprises an anode 86 and a cathode 87. Between the anode 86 and cathode 87 there is an electrically insulating sealing gasket 88. The anode 86 has current-distribution support 89, whereupon there are mounted members 90. The current-distribution support 89 of the anode 86 also serves as the bottom of the electrolyzer. Connected to said current-distribution support 89 are current-conducting buses 91. The current-distribution support 89 is of sheet metal, for example, steel, and has a protective coating, for example, a thin sheet of titanium (not shown). The anode members 90 are made of perforated titanium sheets, whereupon there is applied active anode material, for example, ruthenium dioxide.

The cathode 87 comprises four units 92, 93, 94 and 95 (FIG. 17). The units 92, 93, 94 and 95 have their respective current-distribution supports 96, 97, 98 and 99, whereto there is attached a cathode grid 100 with cathode members 101. Viewed from the top, the current-distribution supports 97 and 98 of the units 93 and 94 are I-shaped. The cathode grid 100 with the cathode members 101 is attached to the current-distribution supports 97 and 98 at the opposite sides of their walls. The cathode grid 100 and cathode members 101 are made of steel mesh. The cathode members 101 are hollow fingers spaced at an equal distance from one another. Connected to the current-distribution supports 96, 97, 98 and 99 are current-conducting buses 102. Welded to the sides of the current-distribution supports 96, 97, 98 and 99 are flanges 103, 104, 105, 106, 107 and 108. Between the flanges 103, 104, 105, 106, 107 and 108 there are placed sealing gaskets 109. The units 92, 93, 94 and 95 are joined together by means of supporting plates 110 and 111 and anchor bolts 112. The current-distribution supports 96, 97, 98 and 99 are tightly joined together and form the walls of the electrolyzer's shell. The electrolyzer has a cover provided with an inlet pipe 114 for the supply of electrolyte and an outlet pipe or first means 115 for the removal of anodic products. The current-distribution supports 96, 97, 98 and 99 are provided with outlet pipes second means or 116, 117, 118 and 119, respectively, for the removal of cathodic products in the direction of the arrow F.

The bipolar electrolyzer of the present invention is assembled as follows.

The units 7, 8 and 9 (FIG. 2) of the anode 3 (FIG. 1) are arranged on the bottom of the shell 1 (FIG. 1). First, the side units 7 and 9 (FIG. 2) are put in place, then the middle unit 8. The units are joined together by bringing into engagement the protrusions 15 and recesses 16.

This is followed by putting in place the bipolar electrodes 5 (FIG. 1). Each bipolar electrode 5 is installed on the bottom of the sheel 1 in a manner similar to that of installing the anode 3, i.e. first, the side units 28 and 30 (FIG. 4) are put in place, and then, the middle unit 29. The units 28, 29 and 30 are joined together by bringing into engagement the protrusions 37 and recesses 38.

Finally, the cathode 4 (FIG. 1) is installed, which is done as in the case of the anode 3, i.e. first, the side units 17 and 19 (FIG. 3) are put in place, and then, the middle unit 18.

An equal spacing between the cathode members 24 and 36 (FIG. 5) and anode members 13 and 34 is ensured with the aid of special master plates.

In the zone of conjunction of the units 7, 8 and 8, 9 (this zone is covered by the cover 6 in the drawing), as well as of the units 30, 29 and 29, 28 (this zone, too, is covered by the cover 6 in the drawing) between the extreme anode members 13 of the adjacent units 7, 8 and 8, 9, as well as between the extreme anode members 34 of the adjacent units 30, 29 and 29, 28, where there are no cathode members, there is formed a space for the circulation of the electrolyte.

After the electrodes 3, 4 and 5 (FIG. 1) have been put in place, the electrolyzer is covered with the cover 6.

The second version of bipolar electrolyzer is assembled as follows.

On a mounting plate (not shown) there are placed the cathode 51 (FIG. 12) and the anode 52, between which there are placed the drums 55 with the sealing gaskets 59, and the cassettes 54. The cathode 51, anode 52, drums 55 with sealing gaskets 59, and cassettes 54 and then tightly joined into a single assembly unit by the supporting plates 56 and 57 and anchor bolts 58. The units of the bipolar electrode 53 are installed in the compartments of each cassette 54.

The drums 55, cathode 51, anode 52 and bipolar electrodes 53 make up a row of closed sections which are covered on top with the covers 60.

The unipolar electrolyzer of the present invention is assembled as follows.

First, the anode 64 (FIG. 14) is assembled. The anode members 68 are mounted with the aid of a master plate on the current-distribution support 67 and rigidly secured thereto. The current-distribution support 67 also serves as the bottom of the electrolyzer.

The gasket 66 is put in place along the perimeter of the support 67. On the gasket 66, there are placed the units 70 and 71 (FIG. 15) of the cathode 65 (FIG. 14). The units 70 and 71 are joined together with the aid of the flanges 77 and 78, that are welded to the current-distribution supports 72 and 73, and the bolts 80. The joint is made leaktight with the aid of the sealing gasket 79. The supports 72 and 73 joined in this manner make up the walls of the electrolyzer's shell.

After the units 70 and 71 have been joined into a single assembly unit, the electrolyzer is covered with the cover 81.

The second version of unipolar electrolyzer in accordance with the invention is assembled as follows.

First, the anode 86 (FIG. 16) is assembled. The anode members 90 are mounted with the aid of a master plate on the current-distribution support 89 and secured thereto. The current-distribution support 89 also serves as the bottom of the electrolyzer. The gasket 88 is put in place along the perimeter of the current-distribution support 89. On the gasket 88 there are placed the middle cathode units 93 ad 94 (FIG. 17), and then the marginal cathode units 92 and 95.

After this, all the units 92, 93, 94 and 95 are joined into a single unit structure by the supporting plates 110 and 111 and anchor bolts 112. In order to make the structure leaktight, the gasket 109 is placed between the flanges 103 and 104, 105 and 106, 107 and 108, which are welded to the current-distribution supports 96, 97, 98 and 99 of the units 92, 93, 94 and 95.

The hermetically joined supports 96, 97, 98 and 99 make up the walls of the electrolyzer's shell. After the units 92, 93, 94 and 95 have been joined into a single unit structure, the electrolyzer is covered with the cover 113.

The present invention is advantageous both technically and economically in many respects.

The invention makes it possible to provide bipolar and unipolar electrolyzers of a considerably greater capacity than the existing types of electrolyzers. The invention makes it possible to produce electrolyzers with a linear load per electrode of 250 to 300 kA.

In addition, the invention makes it possible to replace electrode units in bipolar electrolyzers without dismantling the electrolyzer, which facilitates the maintenance of electrolyzers and reduces idle time and production losses.

Finally, the invention makes it possible to provide an optimum standard electrolyzer intended for a wide range of loads.

What is claimed is:

1. An electrolyzer having a plurality of cell units comprising:

a first electrode which is an anode;

a current-distribution support of said first electrode;

electrode members of said first electrode mounted on said current-distribution support and equidistantly spaced in relation to one another;

a second electrode which is a cathode;

a current-distribution support of said second electrode;

electrode members of said second electrode mounted on said current-distribution support of said second electrode and equidistantly spaced in relation to one another;

at least one bipolar electrode arranged between said first electrode and said second electrode;

said bipolar electrode being composed of at least two units;

current-distribution support of said unit having two opposite sides and side planes;

electrode membes mounted on said opposite sides of said current-distribution supports of said units and equidistantly spaced in relation to one another;

at least one cassette open on top and having two side walls and at least one inner vertical partition dividing said cassette interior into at least two compartments wherein said units of said bipolar electrode are mounted, said side walls and said inner vertical partition being so shaped as to provide mounting slots for said units of said bipolar electrode at a definite position;

said units of said bipolar electrode being mounted in said cassette and joined together by means of said cassette along said side planes of said current-distribution supports of said units;

current-distribution supports of said bipolar electrode formed by said interconnected current-distribution supports of said units;

a separate shell for each cell unit formed by side walls and a bottom, and said cassette arranged therebetween;

a cover for each of said shells;

means for the supply of electrolyte, mounted on said covers; and first and second means for the removal of products of electrolysis, mounted, respectively, on said covers and said shells.

2. An electrolyzer comprising:

a first electrode which is an anode;

a current-distribution support of said first electrode, said current-distribution support being the bottom of the electrolyzer;

electrode members of said first electrode, mounted on said current-distribution support of said first electrode and spaced equidistantly with respect to one another;

a second electrode which is a cathode;

said second electrode being composed of at least two units;

current-distribution supports of said units, having side planes;

electrode members of said units of said second electrode, mounted on said current-distribution supports of said units, equidistantly spaced with respect to one another and arranged between said electrode members of said first electrode;

said units of said second electrode being joined to each other along said side planes of said current-distribution supports of said units;

a current-distribution support of said second electrode, formed by said interconnected current-distribution supports of said units;

means to hermetically join said units of said second electrode to each other along said side planes of said current-distribution supports of said units;

a shell formed by said hermetically connected current-distribution supports of said units of said second electrode and said current-distribution support of said first electrode;

a cover on top of said shell;

means for the supply of electrolyte, mounted on said cover;

first means for the removal of products of electrolysis, mounted on said cover; and second means for the removal of products of electrolysis, mounted on said shell.

* * * * *